United States Patent [19]

Benoit et al.

[11] 4,043,528

[45] Aug. 23, 1977

[54] RELEASABLE SUPPORT ROD

[75] Inventors: Roland Benoit; John Polanski, both of Danielson, Conn.

[73] Assignee: InterRoyal Corporation, New York, N.Y.

[21] Appl. No.: 634,398

[22] Filed: Nov. 24, 1975

[51] Int. Cl.[2] ..... A47H 1/14

[52] U.S. Cl. ..... 248/251; 248/201; 248/316 C; 24/248 R

[58] Field of Search ..... 24/254, 263 SB, 132 SB, 24/248 SB, 249 FP; 211/105.1, 123; 248/64, 201, 205 R, 222, 251, 261, 262, 264, 266, 267, 268, 294, 306, 316 R, 316 B, 316 C, 316 D, 226 C, 226 D, 226 E; 280/183, 184, 185

[56] References Cited

U.S. PATENT DOCUMENTS

| | | | |
|---|---|---|---|
| 805,853 | 11/1905 | Hauk | 248/262 |
| 841,589 | 1/1907 | Simon | 248/316 D UX |
| 1,057,043 | 3/1913 | Dohm | 248/262 |
| 1,080,479 | 12/1913 | Reubel | 248/262 |
| 1,337,594 | 4/1920 | Crosbie | 248/262 |
| 2,256,590 | 9/1941 | Folkestad | 24/254 |
| 2,614,783 | 10/1952 | Spear | 24/263 SB X |
| 2,901,207 | 8/1959 | Adam | 248/294 X |
| 2,989,309 | 6/1961 | Conrad | 248/226 C X |
| 3,847,336 | 11/1974 | Morris et al. | 248/294 |
| 3,900,180 | 8/1975 | McPhee | 248/309 A X |

FOREIGN PATENT DOCUMENTS

| | | | |
|---|---|---|---|
| 75,134 | 12/1952 | Denmark | 248/316 B |
| 67,604 | 3/1951 | Netherlands | 248/262 |
| 398,921 | 3/1966 | Switzerland | 248/316 D |
| 226,643 | 1/1925 | United Kingdom | 248/262 |
| 16,638 | 1/1916 | United Kingdom | 248/262 |

*Primary Examiner*—Lawrence J. Staab
*Attorney, Agent, or Firm*—Arthur A. March

[57] ABSTRACT

A support rod is maintained in position by two load-bearing leaf springs disposed at each end of the rod. The leaf spring members are partially U-shaped in cross-section and the rod is maintained with a loop formed by the U and a back plate. This loop is under a predetermined tautness, the strength of which is created by presetting the tension of a coil spring on the upper flat portion of the load-bearing leaf spring member from which the U-shaped section extends. When an overload is placed upon the support rod, the weight causes the rod to move the U-shaped section of the leaf spring outwardly which thereupon releases the rod from its engagement within the U-shaped loop. As a consequence, the rod will fall with the weight thereon under the force of gravity.

7 Claims, 3 Drawing Figures

RELEASABLE SUPPORT ROD

BACKGROUND OF THE PRESENT INVENTION

Heretofore support rods, as for example clothes rods, used closed or open in closets have been unyieldingly maintained in position extending between the two walls of the closet area. This rigid connection was necessary to support the items normally hung on hangers supported by said rods. In order for the rods to be removed from the position, some manual dexterity had to be used. The rods were so constructed as to be able to bear excessive weights in order to prevent them from collapsing or breaking. As a consequence, such rods were heretofore made of standard sturdy material and no predetermination was made as to the specific amounts of weights to be borne by such rods as long as they could support weights in excess of the amount normally required to maintain heavy clothes and the like in proper position.

Unfortunately, this standard construction of the rods heretofore used has resulted in many instances wherein mentally retarded or disturbed persons, especially children, have with some frequency utilized such rods to fulfill suicidal tendencies. The rods being quite sturdy and unyielding, they will easily support the weight of a child or others seeking self-destruction and this situation has continued to cause severe problems in mental institutions and hospitals.

SUMMARY OF THE PRESENT INVENTION

The present invention overcomes the problems heretofore presented by the heretofore described structure of sturdy, unyielding clothes rods and their capability of such rods for use in fulfilling the aforesaid suicidal tendencies of mentally disturbed patients. The present invention presents structure in which, when the rod is overburdoned by excessive weight such as the weight of a body, it will disengage from the means by which it is held in position and fall under the force of gravity to the point where the overloading weight is no longer supported. In accomplishing this result, the invention also provides means by which the weight to be borne by the rod can be preset for a predetermined amount by simple adjustments.

The present invention contemplates novel and efficient structure comprising L-shaped plates which are secured to each side wall of the closet or the space in which the clothes rod will extend. The side panels of the L-shaped member provided with means for fastening them to the respective side walls of the closet. A leaf spring support member made of resilient material is fastened to the rear panel of each of the L-shaped members by a bolt on any other suitable means. The leaf spring member comprises a flat portion which abuts the rear wall of the L-shaped plate and is fastened thereto. It also includes a portion preferably disposed adjacent to and below the flat portion which is generally U-shaped in cross-section. The base of the U extends outwardly of the L-shaped plate and the side walls of the U-shaped section comprising the top and bottom portion of the support for the rod as hereinafter described. The U-shaped section of the leaf spring support is free and unattached.

In order to adjust the tension and tautness of the leaf spring member and particularly its U-shaped section a coil spring is disposed between the flat portion of the leaf spring member and the head of the fastening bolt or screw. In order to make the tension greater it is only necessary to tighten the end spring by exerting greater pressure against it by the fastening bolt or to loosen the coil spring by relaxing the pressure of the fastening bolt. In this manner, the extent of the support provided by the leaf spring member may be preset to predetermined amounts.

The U-shaped section extends downwardly and may have a flange extending outwardly below the lower portion of the depending U. A conventional clothes rod is secured at each end in the U-shaped sections of the leaf spring support member. The weight which is supportable on the rod is predetermined by the tension applied to the end spring. When a proper weight is being supported the rod will remain in position accommodated by and between the U-shaped sections of the support member at each end of the closet. However, when the rod is overloaded beyond the present amount the free U-shaped section will move outwardly away from the L-shaped plate whereupon the closthes rod and the weight which it bears will fall under the force of gravity to the floor. As a consequence, in the event of an overload situation such as during the course of an attempt at self-destruction wherein the clothes rod is used as a support, the clothes rod will drop from the position in which it is held by the load-bearing support member and fall downwardly thus preventing the unfortunate occurence.

It is to be understood that while the support rod structure has been defined herein in relation to a clothes rod, this invention is not limited to this specific embodiment. Instead, the invention encompasses any form of support in which such releasable means may be utilized.

DETAILED DESCRIPTION OF THE PRESENT INVENTION

Figure 1:
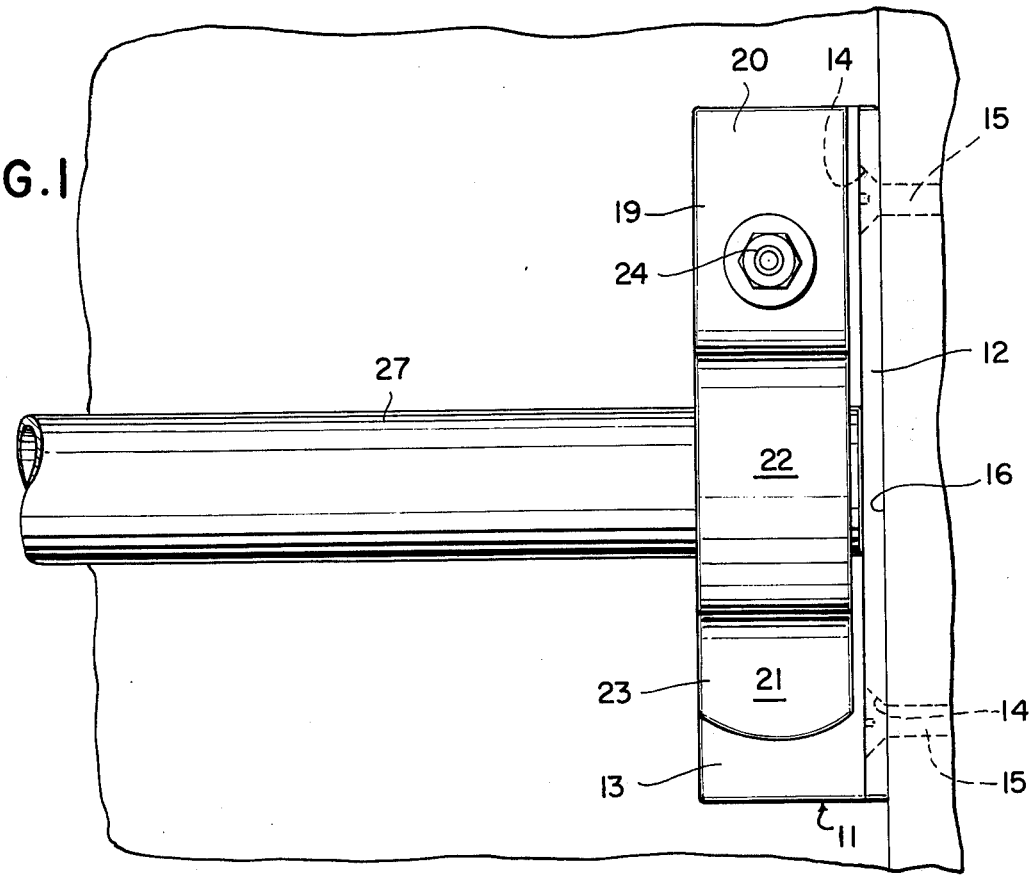
FIG. 1 is a front view of the releasable clothes rod of the present invention with a portion of the clothes rod in position.
Figure 2:
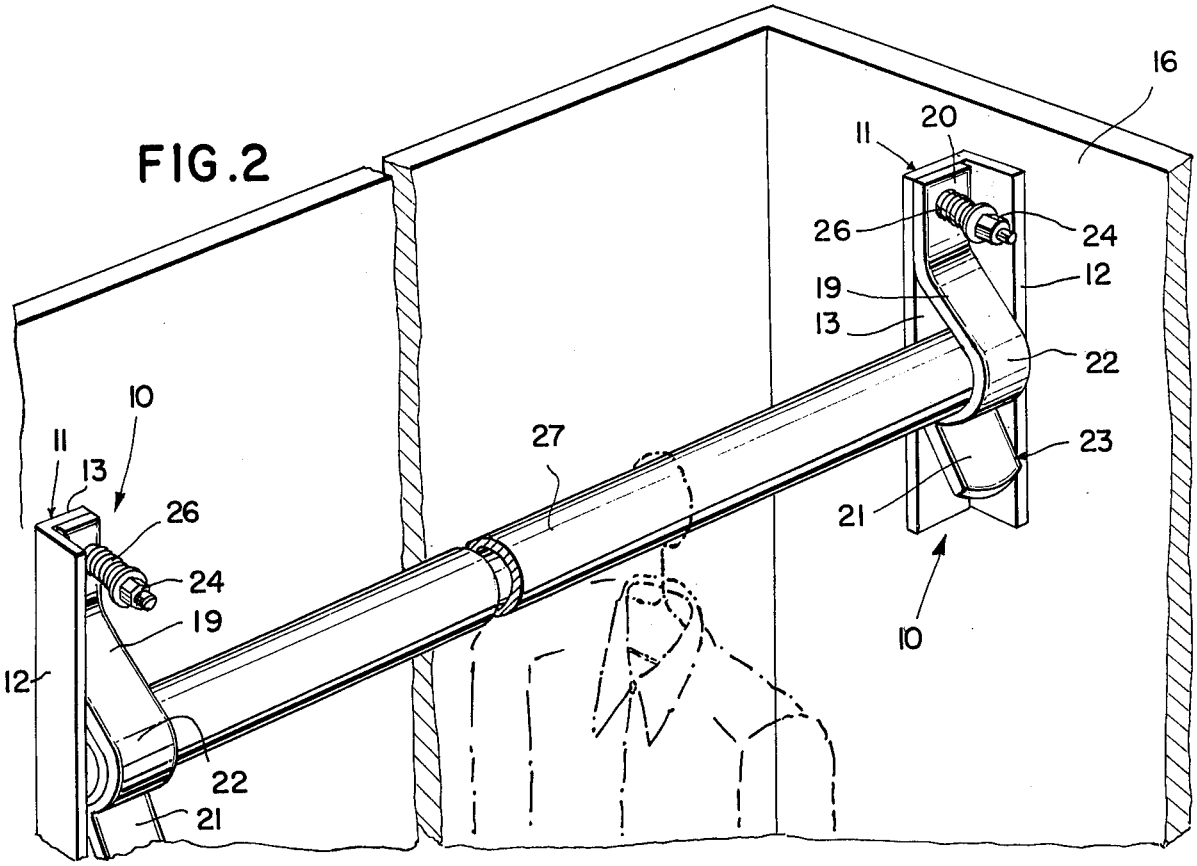
FIG. 2 is a perspective view of the releasable clothes rod in the present invention in position for the reception of clothes hangers.

As shown in the illustration embodiment of the invention there is a clothes rod holder 10. The holder 10 comprises an L-shaped plate member 11 having a side wall section 12 and a rear wall section 13. While the form shown is of a unitary shaped metal plate it, of course, may be of any other suitable bracket means.

The side wall section 12 is provided with apertures 14 which accommodate screws 15 to fasten the bracket assembly 11 to the side wall 16 of a closet.

The rear section 13 has an aperture 17 for the accommodation of a bolt 18 for the purposes hereinafter set forth.

According to the present invention the rod holder also comprises a leaf spring support member 19 of resilient material. The leaf spring member 19 has a relatively flat upper portion 20 and a lower portion 21 which is generally U-shaped in cross-section. The base 22 of the U-shaped portion extends outwardly of and is furthest removed from the rear wall plate 13. A virtually closed loop is formed by the U-shaped portion 21 of the leaf spring support member 19 and the adjacent portion of the rear wall section 13 of the plate 11. Extending from the lower end of the U-shaped portion 21 is an offset extension 23 to manually manipulate the leaf spring member 19 for the purposes hereafter set forth.

A shouldered nut 24 engages the bolt 18 which extends through the aperture 17 in the rear wall section 13 and the aperture 25 provided for this purpose in the flat upper portion 20 of the leaf spring support member 19.

A coil spring 26 is disposed between the shouldered nut 24 and the upper flat portion 20 of the leaf spring member 19. The present invention thus provides the means for maintaining a predetermined amount of tension to be applied to the coil spring merely by adjusting the nut 24 to restrict or relax the release spring as desired. The tension applied to the coil spring 26 in turn determines the tautness of the U-shapeed portion 21 and the amount of pressure exerted on the containment loop formed by said U-shaped portion 21 and the rear wall section 13 of the plate 11.

To assemble the unit to releasably support a clothes rod, a bracket assembly 11 is secured to each side wall 16 of the closet. A leaf spring member 19 is attached to the bracket assembly 11 with the U-shaped loop made taut to the desired extent to provide a predetermined weight carrying support.

A clothes rod 27 is placed in position wherein it is carried and supported by the U-shaped sections 21 of the leaf spring 19 bearing against the rear wall section 13. To locate the rod in position the U-shaped section 21 is moved outwardly by sufficient pressure exerted on the extension 23 to open the loop. Each end of the rod 27 is then disposed in the appropriate position where it is accommodated by the loop when the extension is released and the U-shaped section 21 springs back into position.

Figure 3:
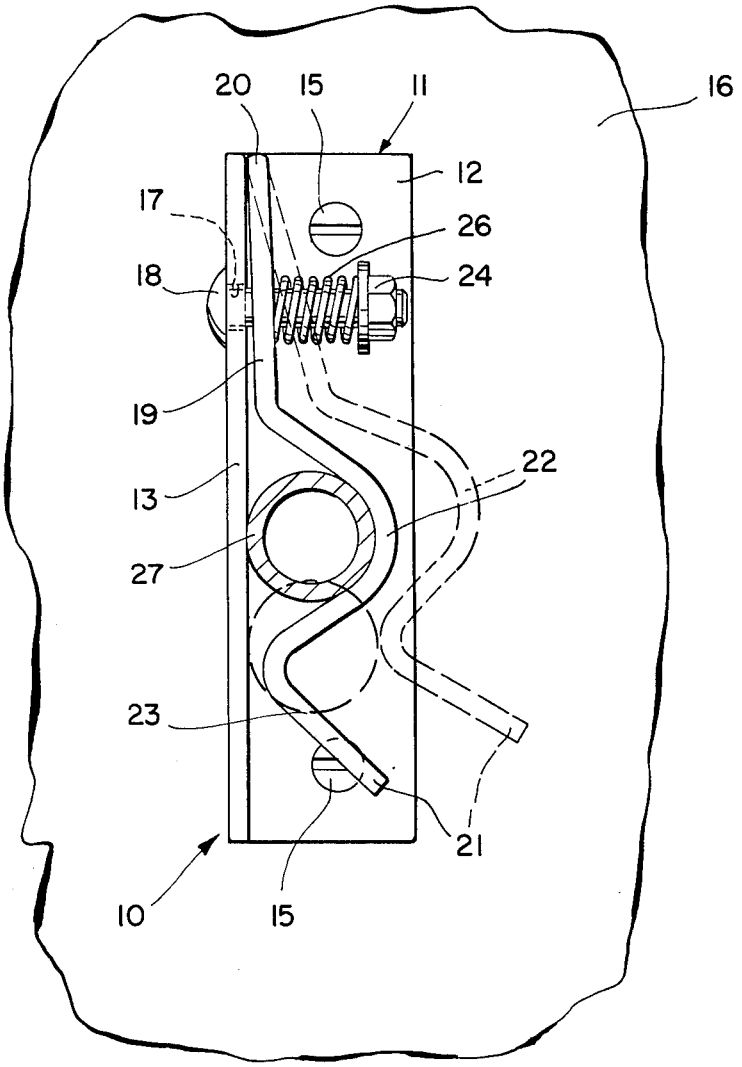
FIG. 3 is a side view of the releasable clothes rod of the present invention in releasing condition showing in dotted lines the position of the rod being released from the holder.

When a predetermined amount of weight is carried by the rod it will remain supported within the loop by the tautness applied to the leaf spring member 19 through the pressure of the coil spring 26. However, in case of an overload the force of the weight exerted on the rod will cause it to move the free U-shaped section 21 outwardly from the rear wall section 13. This action will allow the rod to become released from and escape its containment within the loop, as shown in FIG. 3., and thereafter fall under the force of gravity to the floor. As a consequence of the construction, an undesirable overload caused by, for example, a person bent upon self-destruction, or from any other cause, will release the rod from the position in which it is carried by the support. Thus such attempt will be prevented from succeeding by the unit conceived in this invention.

The present invention has been described by one embodiment thereof using a specific illustration of a clothes rod and examples of material and construction. It is to be understood however that this description is merely to facilitate an understanding of the invention and not as any limitation upon the scope thereof as defined in the appended claims.

What is claimed is:

1. A releasable support rod structure comprising:

plate means disposed for securement in stationary relation to a wall structure and containing an exposed substantially flat vertically oriented face, yieldable load-bearing means separate from and movably engageable with said flat face and having an upper portion abutting said flat face and a depending rod holding portion disposed in below said upper portion opposed facing relation to said flat face and selectively limitedly movably displaceable operatively toward and away from said flat face for holding an independent and separate rod engageably releasably insertable thereat, said yieldable load-bearing means including means for adjusting the tautness thereof for presetting the load-bearing capacity of said yieldable means said rod holding portion being relatively U-shaped in cross-section and having the corresponding open portion of the U-shaped portion thereof disposed in opposed facing relation to said flat face and being selectively limitedly movably displaceable with respect to said flat face to disengage and release said rod under the weight of a downward overload relative to the selective load-bearing adjustment of said yieldable load-bearing means placed directly on said rod and transmitted through said rod to said yieldable load-bearing means.

2. Structure according to to claim 1 wherein said plate means includes a relatively L-shaped member having a side wall section and a rear wall section and adapted for securement along the remote face of said side wall section of the L-shaped member substantially vertically in stationary relation to a vertical wall structure, said exposed flat face constituting the face on the side of said rear wall section facing the face on the side of the side wall section opposite from that containing said side wall remote face.

3. Structure according to claim 1 wherein the yieldable load-bearing means includes a leaf spring having an upper flat portion in abutting movable engagement relation with said plate means.

4. Structure according to claim 1 wherein a selectively adjustable spring member is provided for adjusting the tautness of the yieldable load-bearing means for pre-setting the load-bearing capacity thereof.

5. Structure according to claim 4 wherein an adjustable bolt and nut connection means is provided for operatively movably engageably interconnecting said yieldable load-bearing means with said plate means and the spring member abuts and is maintained under predetermined tension in engagement with the yieldable load-bearing means remote from said plate means by said bolt and nut means.

6. Structure according to claim 1 wherein said yieldable load-bearing means includes a manually manipulatable portion extending from said U-shaped portion to permit limited manual displacement of said U-shaped portion.

7. A releasable support rod structure comprising:

plate means including a relatively L-shaped member having a side wall section and a rear wall section and adapted for securement along the remote face of said side wall section substantially vertically in stationary relation to a vertical wall structure, and containing an exposed substantially flat planar engageable face on the side of said rear wall section facing the adjacent face on the side of the side wall section opposite from that containing said side wall remote face, selectively adjustably yieldable load-bearing means separate from and movably engageable with said plate means, and including a leaf spring having an upper flat portion in abutting movable engagement relation with said flat face, a depending intermediate rod holding portion disposed below said upper portion in opposed facing relation to said flat face and selectively limitedly movably displaceable operatively toward and away from said flat face for holding an independent and separate rod engageably releaseably insertable thereat, and a lower manually manipulatable portion extending from said rod holding portion to permit limited manual displacement of said rod holding portion, and a cooperating selectively adjustable bolt and nut connection means and coil spring for operatively movably engageably interconnecting the leaf spring with the plate means and for adjusting the tautness of the leaf spring for pre-setting the load-bearing capacity thereof, said spring being loaded operatively between the leaf spring upper flat portion and the bolt and nut connection means in abutting engagement relation with the leaf spring and remote from said plate means and maintained under predetermined tension by said bolt and nut connection means, said rod holding portion being relatively U-shaped in cross-section and having the corresponding open portion of the U-shaped portion thereof disposed in opposed facing relation to said flat face and being selectively limitedly movably displaceable with respect to said flat face to disengage and release said rod under the weight of a downward overload relative to the selective load-bearing adjustment of said leaf spring placed directly on said rod and transmitted through said rod to said leaf spring.

* * * * *